US007482984B2

(12) United States Patent
Rosengren et al.

(10) Patent No.: US 7,482,984 B2
(45) Date of Patent: Jan. 27, 2009

(54) HOOP ANTENNA

(75) Inventors: Kent Rosengren, Kalmar (SE); Joacim Rylander, Kalmar (SE)

(73) Assignee: Flextronics AP, LLC, Broomfield, CO (US)

( * ) Notice: Subject to any disclaimer, the term of this patent is extended or adjusted under 35 U.S.C. 154(b) by 0 days.

(21) Appl. No.: 11/644,728

(22) Filed: Dec. 22, 2006

(65) Prior Publication Data

US 2008/0150809 A1 Jun. 26, 2008

(51) Int. Cl.
*H01Q 1/24* (2006.01)

(52) U.S. Cl. ..... 343/702; 343/700 MS; 343/846

(58) Field of Classification Search ..... 343/702, 343/700 MS, 846
See application file for complete search history.

(56) References Cited

U.S. PATENT DOCUMENTS

| | | | | |
|---|---|---|---|---|
| 5,764,190 | A | 6/1998 | Murch et al. | 343/702 |
| 6,140,966 | A | 10/2000 | Pankinaho | 343/700 |
| 6,680,705 | B2 | 1/2004 | Tan et al. | 343/702 |
| 6,693,594 | B2 | 2/2004 | Pankinaho et al. | 343/700 |
| 7,026,996 | B2 * | 4/2006 | Harano | 343/700 MS |
| 7,026,999 | B2 * | 4/2006 | Umehara et al. | 343/702 |
| 7,119,743 | B2 * | 10/2006 | Iguchi et al. | 343/700 MS |
| 7,319,432 | B2 * | 1/2008 | Andersson | 343/702 |
| 2005/0007283 | A1 | 1/2005 | Jo et al. | 343/702 |
| 2005/0195124 | A1 | 9/2005 | Baliarda et al. | 343/893 |
| 2007/0139280 | A1 | 6/2007 | Vance | 343/702 |

FOREIGN PATENT DOCUMENTS

| | | |
|---|---|---|
| EP | 1 018 779 B1 | 7/2000 |
| EP | 1 108 616 A2 | 6/2001 |
| WO | WO 01/82412 A2 | 1/2001 |

* cited by examiner

*Primary Examiner*—Hoang V Nguyen
(74) *Attorney, Agent, or Firm*—Haverstock & Owens LLP

(57) ABSTRACT

An antenna for use in a relatively small confined space, such as a mobile phone, is provided. In one example, the antenna includes a feeding arm having an end coupled to a feeding contact; and a grounded arm having an end coupled to a ground contact, wherein the feeding arm and the grounded arm are bent to conform to the relatively small confined volume. The relatively small confined volume can be internal space of a mobile communication device. The mobile communication device can be a mobile phone, for example.

31 Claims, 4 Drawing Sheets

HOOP ANTENNA

BACKGROUND OF THE INVENTION

1. Field of the Invention

The present invention generally relates to relatively electrical small antennas. More particularly, the present invention relates to antenna structures for mobile communication devices having constraints on internal space and battery consumption.

2. Discussion of Background

There has been increasing need for innovative antennas on mobile terminals in wireless communications including the global system for mobile communications (GSM850) or extended GSM (EGSM), the digital communication system (DCS), the personal communication system (PCS), and wideband code-division multiple access (WCDMA). Constraints on such antenna design include requirements of multiband or broadband resonance, limitation of space in handheld devices, reduction of radio absorption in the user's head or body for antenna efficiency and safety measures, and cost reduction. Traditional antennas such as monopoles, dipoles and even patches are unable to meet these requirements and hence alternative approaches are needed.

Planar antennas have features of low cost, low profile and light weight. However, a planar antenna performance is related to the shape and dimensions of the antenna wires and slits or slots on ground planes and have quite narrow bandwidth.

FIG. 1 (PRIOR ART) is a drawing of a known basic model of a planar inverted-F antenna (PIFA) antenna 100 comprising a planar electrically conductive radiating element 101, electrically conductive ground plane 102 parallel to the radiating element 101, and, connecting these two, a ground contact 103 which is substantially perpendicular to the radiating element 101 and ground plane 102. The structure further includes a feed electrode 104, which also is substantially perpendicular to the radiating element 101 and ground plane 102 and which can be coupled to an antenna port (not shown) of a radio apparatus. In the structure of FIG. 1, the radiating element 101, ground contact 103 and the feed electrode 104 are usually manufactured by cutting or stamping a thin metal sheet into a suitable shape, which is conformable to the housing to some degree and which has two protrusions bent to a right angle. The ground plane 102 may be composed of a metallized area on the surface of a printed circuit board (PCB) so that the ground contact 103 and the feed electrode 104 are easily connected to electrodes on the printed circuit board. The electrical characteristics of the antenna 100 are affected in general by the dimensions of its elements and, in particular, by the size of the radiating element 101 and its distance from the ground plane 102.

FIG. 2 (PRIOR ART) is a drawing of a PIFA structure 200 according to European Patent document No. 484,454, wherein a radiating element 201, ground plane 202 and a ground contact 203 connecting these two are realized as metal platings on surfaces of a solid dielectric body 204. The antenna is fed through a coupling element 205, which does not touch the radiating element 201. An electromagnetic coupling exists between the coupling element 205 and radiating element 201, and the coupling element 205 extends over the edge of the dielectric body 204 to a point that can be coupled to the antenna port of a radio apparatus. The structure is mechanically sturdy, but the dielectric body block makes it relatively heavy. Further, the dielectric body makes the impedance bandwidth of the antenna narrower and degrades the radiation efficiency as compared to an air-insulated PIFA structure.

FIG. 3 (PRIOR ART) is a drawing of known PIFA structure 300 having a known design of a PIFA radiating element 301. The rectangular shape is broken by a gap 302, which forms a strip in that portion of the radiating element which is farthest away from the feed point 303 and ground contact 304. The purpose of the gap typically is to increase the electrical length of the antenna and, thereby, to affect the antenna's resonating frequency.

All the PIFA structures described above are designed such that they have a certain resonating frequency, as well as an operating frequency band centered around the resonating frequency. However, these PIFA structures are not designed to fit in a small confined space while communicating efficiently in a wide frequency band.

What is needed is an antenna that can fit in a relatively small confined space while communicating efficiently in a broadband network.

SUMMARY OF THE INVENTION

It is recognized that what is needed is a small antenna that can communicate at wide frequency bandwidths. Broadly speaking, the present invention fills these needs by providing a hoop shape antenna for use in a small confined space, such as a mobile phone. It should be appreciated that the present invention can be implemented in numerous ways, including as an apparatus, a system or a device. Inventive embodiments of the present invention are summarized below.

In one embodiment, an antenna for use in a relatively small confined space is disclosed. The antenna comprises a feeding arm having an end coupled to a feeding contact; and a grounded arm having an end coupled to a ground contact, wherein the feeding arm and the grounded arm are bent to conform to the relatively small confined volume. The relatively small confined volume can be internal space of a mobile communication device. The mobile communication device can be a mobile telephone, for example.

In another embodiment, an antenna for use in a relatively small confined space is provided. The antenna comprises a feeding arm having an end coupled to a feeding contact; and a ground plane having a grounded arm, wherein the feeding contact is coupled to the ground plane, and wherein the ground plane and the grounded arm form an insulated portion around the feeding arm. The insulated portion can be substantially air.

In yet another embodiment, an antenna for use in a relatively small confined space is provided. The antenna comprises a feeding arm having an end coupled to a feeding contact; and a printed circuit board having a grounded arm, wherein the feeding contact is coupled to the printed circuit board, and wherein the printed circuit board and the grounded arm form an insulated portion around the feeding arm.

Advantageously, the hoop shape antenna of the present invention is capable of transmitting signals in both a radio and mobile network at a wide frequency bandwidth. Further, this hoop antenna is more efficient than conventional antennas with respect to battery usage. Also, the hoop shape, particularly when designed into the structure of a printed circuit board, is less costly to manufacture.

The invention encompasses other embodiments are configured as set forth above and with other features and alternatives.

BRIEF DESCRIPTION OF THE DRAWINGS

The present invention will be readily understood by the following detailed description in conjunction with the accompanying drawings. To facilitate this description, like reference numerals designate like structural elements.

DESCRIPTION OF THE PREFERRED EMBODIMENTS

An invention for hoop shape antenna for use in a relatively small space, such as a mobile phone, is disclosed. Numerous specific details are set forth to provide a thorough understanding of the present invention. It will be understood, however, to one skilled in the art, that the present invention can be practiced with other specific details.

Figure 1:
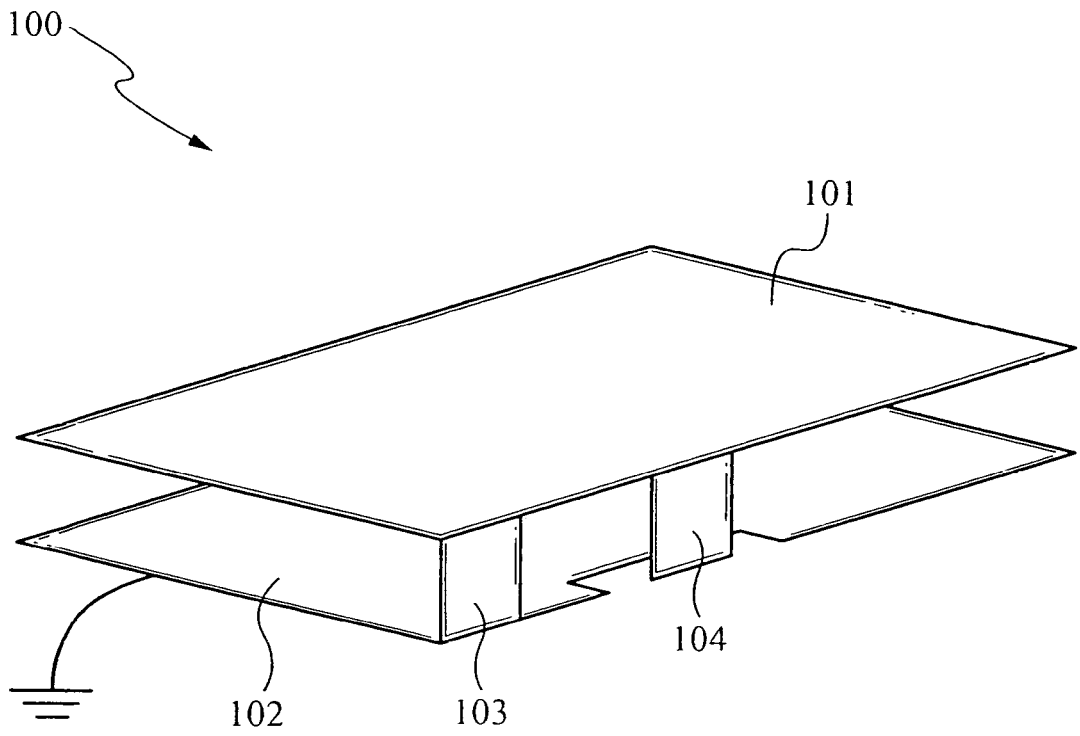
Fig. 1 (PRIOR ART)
FIG. 1 (PRIOR ART) is a drawing of a known basic model of a planar inverted-F antenna (PIFA) antenna.
Figure 2:
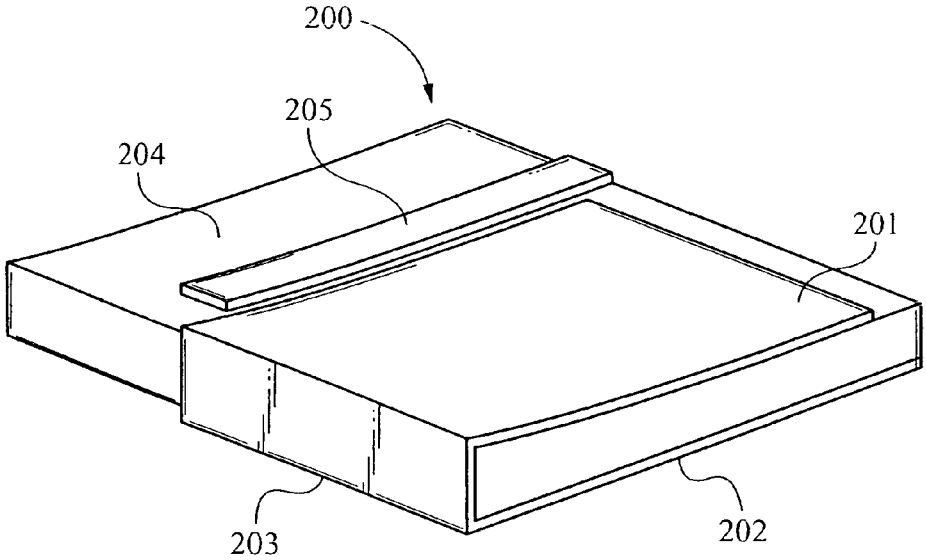
Fig. 2 (PRIOR ART)
FIG. 2 (PRIOR ART) is a drawing of a PIFA structure according to European Patent document No. 484,454.
Figure 3:
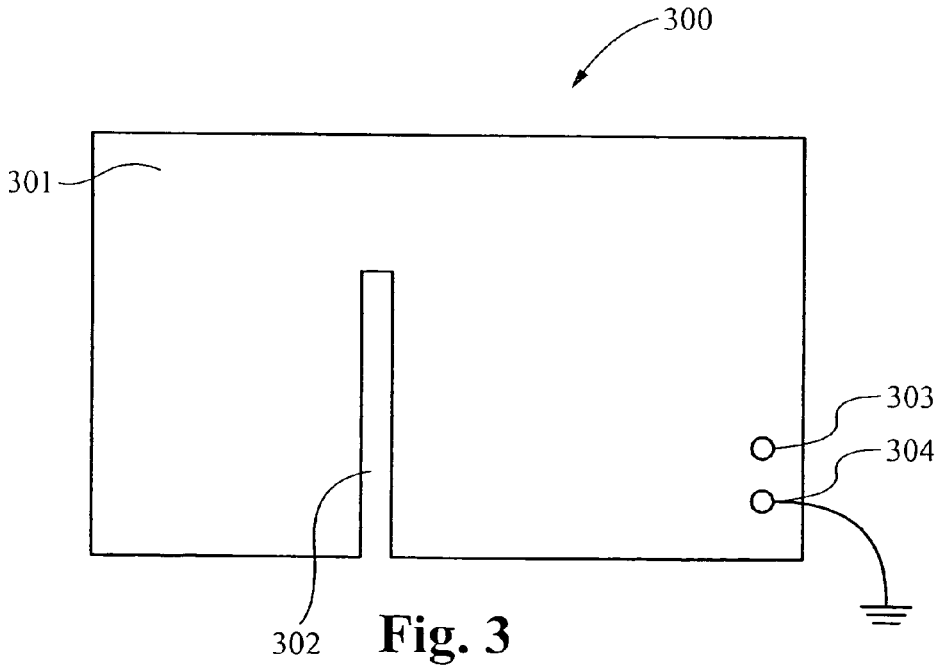
Fig. 3 (PRIOR ART)
FIG. 3 (PRIOR ART) is a drawing of known PIFA structure having a known design of a PIFA radiating element.
Figure 4:
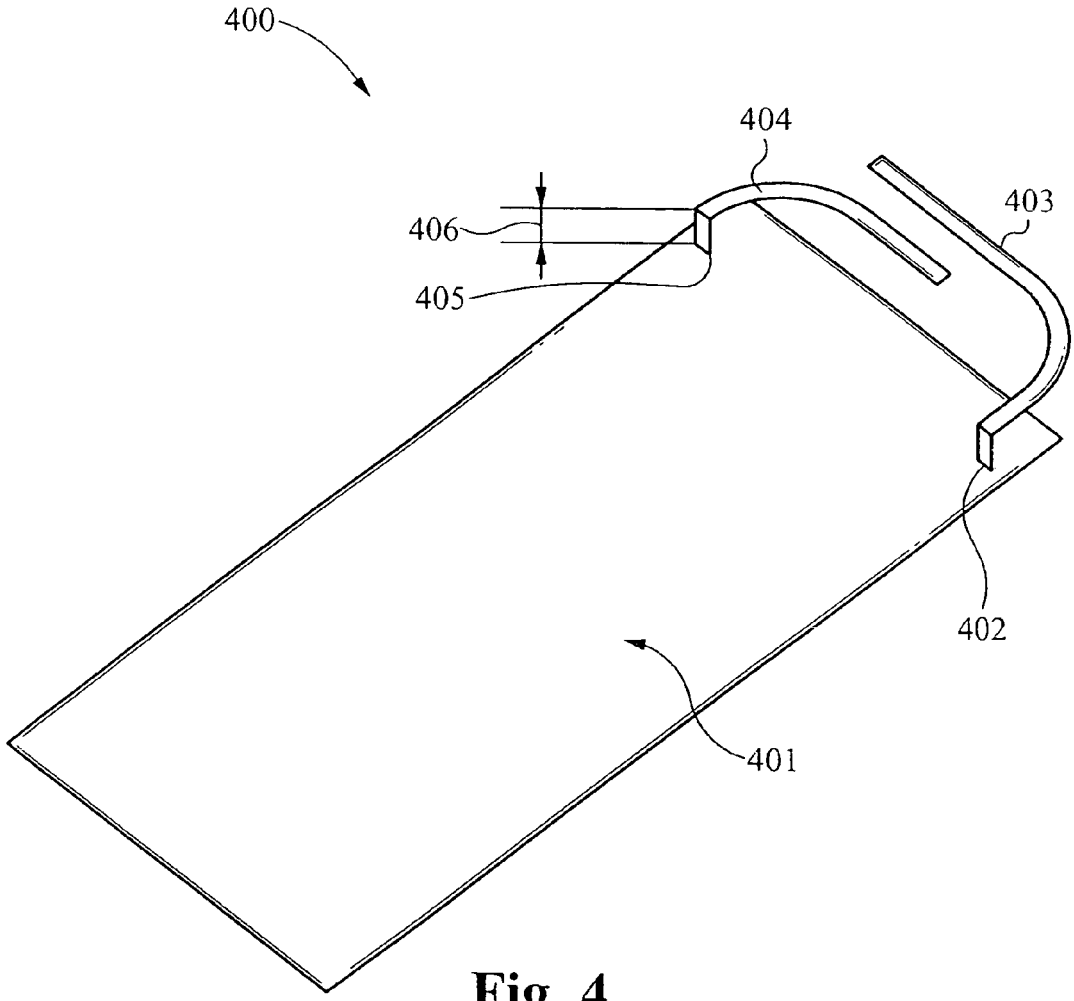
FIG. 4 is a drawing of a hoop antenna for a mobile communication device, in accordance with the present invention.

FIG. 4 is a drawing of a hoop antenna 400 for a mobile communication device, in accordance with the present invention. The hoop antenna 400 includes a ground plane 401. Examples of a ground plane include copper on FR4 laminate, a printed circuit board or other dielectric material. One end of a feeding arm 404 is electrically coupled to a feeding contact 405. The feeding contact 405 is electrically coupled to the ground plane 401. One end of a ground arm 403 is electrically coupled to a ground contact 402. The ground contact 402 is electrically coupled to the ground plane 401.

The feeding arm 404 is the antenna port for transmitting signals to other RF devices. The feeding arm 404 can communicate in either a radio or mobile band. The feeding arm 404 is preferably part of a broadband network. This broadband network can be, for example, a global system for mobile communications (GSM) network an extended global system for mobile communications (EGSM) network, a digital communication system (DCS) network, a personal communication system (PCS) network or a wide-band code-division multiple access (WCDMA) network or broadband wireless systems, for example, wireless local area network (WLAN).

The feeding arm 404 is bent into a hoop shape, as shown in FIG. 4. This hoop shape assists the feeding arm 404 in transmitting signals in the broadband network with high radiation efficiency. In other words, the antenna can transmit signals in the broadband network without unduly draining the battery of the mobile communication device. The hoop shape allows the feeding arm 404 to fit into a small confined space of the mobile communication device. A mobile phone, for example, has limited space for an internal antenna. Accordingly, many conventional mobile phone designs have antennas extruding outside the main body of the mobile phone. The hoop shape of the antenna of the present invention allows the antenna to remain within the body of the mobile phone. Other mobile communication devices face a similar design challenge. The hoop shape design allows the small antenna of the present invention to fit flush into these other mobile communication devices and to communicate in a broadband network. Examples of other mobile communication devices include a handheld radio, a Bluetooth device wireless local area network device and a wireless access point.

Some parts of the hoop antenna extend outside of the ground plane 401, as shown in FIG. 4. However, such a design is not required. The particular layout of the mobile communication device can call for an antenna that lies flush within the ground plane 401. In this embodiment, the feeding arm 404 is shown to protrude away from the ground plane at a height 406. One reason to have the antenna extend outside the ground plane 401 is that the antenna, including the feeding arm 404 and the grounded arm 403, is somewhat sensitive to metal when metal is in close proximity to the antenna. Accordingly, in certain circumstances the antenna can be improved by providing a certain amount of space away from the ground plane 401 to transmit signals more efficiently.

Figure 5:
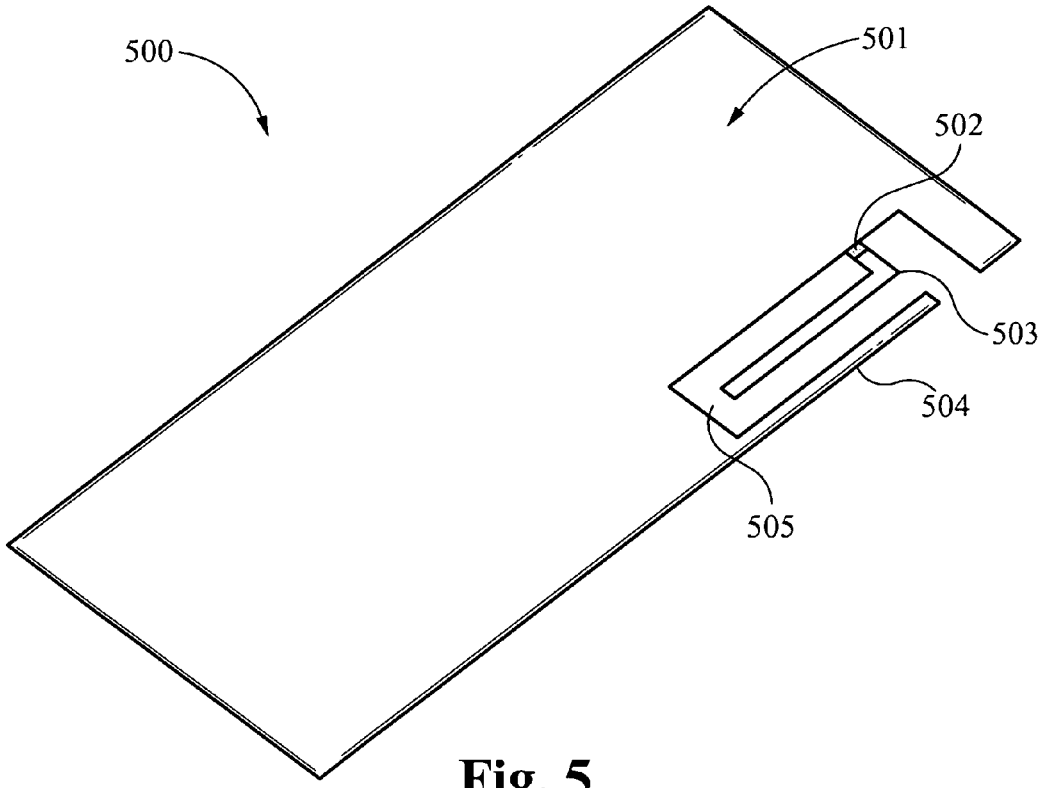
FIG. 5 is a drawing of another embodiment of a hoop antenna for a mobile communication device, in accordance with the present invention.

FIG. 5 is a drawing of another embodiment of a hoop antenna, in accordance with the present invention. The hoop antenna 500 includes a ground plane 501, for example. The ground plane 501 can be a printed circuit board. One end of a feeding arm 503 is electrically coupled to a feeding contact 502. The feeding contact 502 is electrically coupled to the ground plane 501. The feeding contact 502 is preferably a microstrip feeding line with a 50 ohms characteristic impedance that feeds the antenna. Alternatively, the feeding contact 502 is a coaxial or a stripline feeding line.

In this embodiment, the feeding arm 503 is small and is designed into the structure of the printed circuit board 501. Such a design, relative to other antenna designs, is cost effective to manufacture. As shown in FIG. 5, a grounded arm 504 comes up around the feeding arm 503. An air gap 505 occupies the space around the feeding arm 503. This air gap 505 provides an electrically insulating buffer between the feeding arm 503 and the printed circuit board 501, and between the feeding arm 503 and the grounded arm 504. As an alternative to air, a portion of un-metallized printed circuit board, or a dielectric material such as FR4, can occupy this space around the feeding arm 503. Any appropriately shaped grounded arm 504 or grounded metal can be fed reactively and radiate power.

The ground plane 501 is preferably about 20-40 mm by 10-20 mm or larger. Smaller dimensions apply to smaller sized devices, such as Bluetooth devices. However, for lower frequencies, such as GSM850, the dimensions of the ground plane 501 are larger. In general, performance of the antenna increases as the size of the ground plane 501 increases. In one embodiment, the ground plane 501 is preferably about 30-40 mm by 10-20 mm. However, other dimensions can be suitable, depending on the design of the particular mobile communication device.

In the foregoing specification, the invention has been described with reference to specific embodiments thereof. It will, however, be evident that various modifications and changes can be made thereto without departing from the broader spirit and scope of the invention. The specification and drawings are, accordingly, to be regarded in an illustrative rather than a restrictive sense.

What is claimed is:

1. An antenna for use in a relatively small confined space, the antenna comprising:

a. a feeding arm having an end configured to be coupled to a feeding contact, wherein the feeding arm protrudes away from a ground plane at a predetermined height; and b. a grounded arm having an end configured to be coupled to a ground contact, wherein the feeding arm and the grounded arm are bent to conform to the relatively small confined volume, wherein the feeding arm is bent like a portion of a hoop shape, and wherein the grounded arm is bent like a portion of another hoop shape.

2. The antenna of claim 1, wherein the relatively small confined volume is internal space of a mobile communication device.

3. The antenna of claim 2, wherein the mobile communication device is a mobile telephone.

4. The antenna of claim 2, wherein the mobile communication device is at least one of:

a. a Bluetooth device;

b. a wireless local area network device; and c. a wireless access point.

5. The antenna of claim 2, wherein the mobile communication device is a handheld radio.

6. The antenna of claim 1, wherein the feeding contact is further coupled to the ground plane of a printed circuit board, and wherein the ground contact is further coupled to the ground plane.

7. The antenna of claim 6, wherein the feeding arm extends outside of the ground plane of the printed circuit board, and wherein the grounded arm extends outside of the ground plane of the printed circuit board.

8. The antenna of claim 1, wherein the feeding contact is further coupled to at least one of a coaxial cable, a microstrip and a stripline feeding line, wherein the ground contact is further coupled to a ground plane.

9. The antenna of claim 8, wherein the ground plane is at least one of:

a. copper on FR4 laminate; and b. another dielectric material.

10. The antenna of claim 8, wherein the feeding arm extends outside of the ground plane, and wherein the grounded arm extends outside of the ground plane.

11. The antenna of claim 1, wherein the antenna is sensible to metal in close proximity to the antenna.

12. The antenna of claim 1, wherein the ground arm is reactively coupled to the feeding arm to radiate power.

13. The antenna of claim 1, wherein the feeding arm transmits signals on a broadband network.

14. The antenna of claim 13, wherein the broadband network is at least one of:

a. a global system for mobile communications (GSM) network;

b. an extended global system for mobile communications (EGSM) network;

c. a digital communication system (DCS) network;

d. a personal communication system (PCS) network;

e. a wide-band code-division multiple access (WCDMA) network;

f. Bluetooth; and g. a wireless local area network (WLAN).

15. An antenna for use in a relatively small confined space, the antenna comprising:

a. a feeding arm having an end configured to be coupled to a feeding contact; and b. a ground plane having a grounded arm, wherein a grounded arm feeding contact is coupled to the ground plane, and wherein the ground plane and the grounded arm form an insulated portion around the feeding arm, and wherein the feeding arm is bent into a portion of a hoop shape and the grounded arm is bent into a portion of another hoop shape, and further wherein an open end of the feeding arm faces away from an open end of the grounded arm.

16. The antenna of claim 15, wherein the feeding contact for the feeding arm is at least one of:

a. a coaxial cable;

b. a microstrip; and c. a stripline.

17. The antenna of claim 15, wherein the insulated portion is at least one of:

a. substantially air;

b. FR4; and c. another dielectric material.

18. The antenna of claim 15, wherein the ground plane is at least one of:

a. copper on FR4 laminate; and b. another dielectric material.

19. The antenna of claim 15, wherein the feeding arm transmits signals on a broadband network.

20. The antenna of claim 19, wherein the broadband network is at least one of:

a. a global system for mobile communications (GSM) network;

b. an extended global system for mobile communications (EGSM) network;

c. a digital communication system (DCS) network;

d. a personal communication system (PCS) network;

e. a wide-band code-division multiple access (WCDMA) network;

f. Bluetooth; and g. a wireless local area network (WLAN).

21. The antenna of claim 15, wherein the ground plane has a length between about 20 mm and about 40 mm, and wherein the ground plane has a width between about 10 mm and about 20 mm.

22. The antenna of claim 15, wherein the ground plane has a length of at least 40 mm and a width of at least 20 mm.

23. An antenna for use in a relatively small confined space, the antenna comprising:

a. a feeding arm having an end configured to be coupled to a feeding contact; and b. a printed circuit board having a grounded arm, wherein the feeding contact is coupled to the printed circuit board, and wherein the printed circuit board and the grounded arm form an insulated portion around the feeding arm, and further wherein the feeding arm is bent into a portion of a hoop shape and the grounded arm is bent into a portion of another hoop shape.

24. The antenna of claim 23, wherein the feeding contact is at least one of:

a. a coaxial cable;

b. a microstrip line; and c. a stip line.

25. The antenna of claim 23, wherein the insulated portion is an un-metallized portion of the printed circuit board.

26. The antenna of claim 23, wherein the grounded arm is grounded metal.

27. The antenna of claim 23, wherein the feeding arm transmits signals on a broadband network.

28. The antenna of claim 27, wherein the broadband network is at least one of:

a. a global system for mobile communications (GSM) network;

b. an extended global system for mobile communications (EGSM) network;

c. a digital communication system (DCS) network;

d. a personal communication system (PCS) network;

e. a wide-band code-division multiple access (WCDMA) network;

f. Bluetooth; and g. a wireless local area network (WLAN).

29. The antenna of claim 23, wherein the feeding arm is designed into a structure of the printed circuit board.

30. An antenna for use in a relatively small confined space, the antenna comprising:

a. a feeding arm having an end configured to be coupled to a feeding contact, wherein the feeding arm protrudes away from a ground plane at a predetermined height; and b. a grounded arm having an end configured to be coupled to a ground contact, wherein the feeding arm and the grounded arm are bent to conform to the relatively small confined volume, wherein the feeding contact is further coupled to the ground plane of a printed circuit board, wherein the ground contact is further coupled to the ground plane, wherein the feeding aim extends outside of the ground plane of the printed circuit board, and wherein the grounded arm extends outside of the ground plane of the printed circuit board.

31. An antenna for use in a relatively small confined space, the antenna comprising:

a. a feeding arm having an end configured to be coupled to a feeding contact, wherein the feeding arm protrudes away from a ground plane at a predetermined height; and b. a grounded arm having an end configured to be coupled to a ground contact, wherein the feeding arm and the grounded arm are bent to conform to the relatively small confined volume, wherein the feeding contact is further coupled to at least one of a coaxial cable, a microstrip and a stripline feeding line, wherein the ground contact is further coupled to a ground plane, wherein the feeding arm extends outside of the ground plane, and wherein the grounded arm extends outside of the ground plane.

* * * * *

UNITED STATES PATENT AND TRADEMARK OFFICE

CERTIFICATE OF CORRECTION

PATENT NO. : 7,482,984 B2
APPLICATION NO. : 11/644728
DATED : December 22, 2006
INVENTOR(S) : Rosengren et al.

It is certified that error appears in the above-identified patent and that said Letters Patent is hereby corrected as shown below:

IN THE SPECIFICATION

At column 4, lines 5-6, please replace "a Bluetooth device wireless local area network device" with "a Bluetooth device, wireless local area network device" so that the corresponding sentence reads: -- Examples of other mobile communication devices include a handheld radio, a Bluetooth device, wireless local area network device and a wireless access point. --

IN THE CLAIMS

In Claim 30 at column 7, line 18, please replace "wherein the feeding aim" with "wherein the feeding arm" so that the corresponding portion of the claim reads:
-- wherein the feeding arm extends outside of the ground plane of the printed circuit board, --

Signed and Sealed this

Twenty-fourth Day of March, 2009

John Doll

JOHN DOLL
*Acting Director of the United States Patent and Trademark Office*

UNITED STATES PATENT AND TRADEMARK OFFICE

CERTIFICATE OF CORRECTION

PATENT NO. : 7,482,984 B2
APPLICATION NO. : 11/644728
DATED : January 27, 2009
INVENTOR(S) : Rosengren et al.

It is certified that error appears in the above-identified patent and that said Letters Patent is hereby corrected as shown below:

IN THE SPECIFICATION

At column 4, lines 5-6, please replace "a Bluetooth device wireless local area network device" with "a Bluetooth device, wireless local area network device" so that the corresponding sentence reads: -- Examples of other mobile communication devices include a handheld radio, a Bluetooth device, wireless local area network device and a wireless access point. --

IN THE CLAIMS

In Claim 30 at column 7, line 18, please replace "wherein the feeding aim" with "wherein the feeding arm" so that the corresponding portion of the claim reads:
-- wherein the feeding arm extends outside of the ground plane of the printed circuit board, --

This certificate supersedes the Certificate of Correction issued March 24, 2009.

Signed and Sealed this

Fourteenth Day of April, 2009

John Doll

JOHN DOLL
*Acting Director of the United States Patent and Trademark Office*